US005661810A

United States Patent [19]

Chahabadi et al.

[11] Patent Number: 5,661,810

[45] Date of Patent: Aug. 26, 1997

[54] CIRCUIT ARRANGEMENT FOR DERIVING SIGNALS FOR MASKING AUDIO SIGNALS

[75] Inventors: Djahanyar Chahabadi; Matthias Herrmann, both of Hildesheim; Lothar Vogt, Barienrode; Jürgen Kaesser, Diekholzen, all of Germany

[73] Assignee: Robert Bosch GmbH, Stuttgart, Germany

[21] Appl. No.: 522,314

[22] PCT Filed: Mar. 22, 1994

[86] PCT No.: PCT/DE94/00321

§ 371 Date: Aug. 25, 1995

§ 102(e) Date: Aug. 25, 1995

[87] PCT Pub. No.: WO94/22229

PCT Pub. Date: Sep. 29, 1995

[30] Foreign Application Priority Data

Mar. 24, 1993 [DE] Germany ..... 43 09 518.6

[51] Int. Cl.[6] ..... H04H 5/00

[52] U.S. Cl. ..... 381/13; 381/10

[58] Field of Search ..... 381/1, 3, 4, 2, 381/7, 10, 11, 13

[56] References Cited

U.S. PATENT DOCUMENTS

| | | | |
|---|---|---|---|
| 4,454,607 | 6/1984 | Ogita | 381/7 |
| 4,497,063 | 1/1985 | Ishida et al. | 381/7 |
| 4,703,501 | 10/1987 | Sugai et al. | 381/11 |
| 4,901,350 | 2/1990 | Anderson et al. | 381/13 |
| 5,027,402 | 6/1991 | Richards, Jr. et al. | 381/13 |
| 5,249,233 | 9/1993 | Kennedy et al. | 381/13 |
| 5,257,312 | 10/1993 | Therssen et al. | 381/13 |
| 5,432,854 | 7/1995 | Honjo et al. | 381/11 |
| 5,506,906 | 4/1996 | Herrmann | 381/13 |

FOREIGN PATENT DOCUMENTS

418036A2 12/1991 European Pat. Off. .

*Primary Examiner*—Curtis Kuntz
*Assistant Examiner*—Vivian Chang
*Attorney, Agent, or Firm*—Michael J. Striker

[57] ABSTRACT

The circuit arrangement includes a first low-pass filter (2) for filtering an input signal (H3) proportional to the strength of a received radio signal; a second low-pass filter (3) for filtering the input signal (H3); a first weighting circuit (7) for weighting the first low-pass filter output signal with first coefficients to form a first weighted output signal; a circuit device for forming a masking signal for reducing stereo channel isolation from the first weighted output signal; a second weighting circuit (5) for forming a second weighted output signal weighted with second coefficients from the first low-pass filter output signal or the second low-pass filter output signal according to a switching signal (DD2) indicative of interference in the audio signals; a switch device (4) for selecting the first low-pass filter output signal for weighting in the second weighting circuit means (5) when no interference is indicated by the switching signal (DD2) and the second low-pass filter output signal for weighting in the second weighting circuit means (5) when interference is indicated by the switching signal (DD2); and a circuit device for forming a masking signal for damping the audio signal from the second weighted output signal.

7 Claims, 4 Drawing Sheets

SK
2/4

50
40
30
20
10
0
-90
-80
-70
-60
-50
-40
-30
-20
-10
0
E

L
0
-10
-20
-30
-40
-50
-90
-80
-70
-60
-50
-40
-30
-20
-10
0
E

CIRCUIT ARRANGEMENT FOR DERIVING SIGNALS FOR MASKING AUDIO SIGNALS

BACKGROUND OF THE INVENTION

The invention relates to a circuit arrangement for deriving signals for masking audio signals in a broadcast radio receiver.

Particularly in the case of automobile radios, the reception quality can fluctuate severely as a result of glitches in the received field strength. In order to keep the interference caused by this as low as possible, measures are known for masking this interference in audio signals. For example, if the received field strength is low, it is thus possible to reduce the stereo channel isolation or to temporarily attenuate the audio signals.

SUMMARY OF THE INVENTION

The object of the present invention is to specify a circuit arrangement for a broadcast radio receiver, in particular for an automobile radio having digital signal processing, by means of which suitable signals for masking the audio signals are produced.

According to the invention, the circuit arrangement for deriving masking signals for masking audio signals in a broadcast radio receiver includes a first low-pass filter means for filtering an input signal substantially proportional to a received field strength in the radio receiver to form a first low-pass filter output signal; a second low-pass filter means for filtering the input signal to form a second low-pass filter output signal; a first weighting circuit means for weighting the first low-pass filter output signal of the first low-pass filter means with first coefficients to form a first weighted output signal; means for forming a masking signal for reducing stereo channel isolation from the first weighted output signal of the first weighting circuit means; second weighting circuit means for forming a second weighted output signal from the first low-pass filter output signal or the second low-pass filter output signal with second coefficients according to a switching signal indicative of the presence of interference in the audio signals; switching means for selecting the first low-pass filter output signal for weighting in the second weighting circuit means when no interference is indicated by the switching signal and the second low-pass filter output signal for weighting in the second weighting circuit means when interference is indicated by the switching signal; and means for forming a masking signal for damping the audio signal from the second weighted output signal of the second weighting circuit means.

The circuit arrangement according to the invention has the advantage that the signals which are produced can be matched to the masking which is respectively to be carried out so that an intervention, which is carried out by the masking, in the audio signals does not cause further audible interference, as far as possible.

In the case of an advantageous embodiment it is provided that the masking is carried out by attenuation of the audio signals and that the predetermined function contains a linear component and a constant component, each having a coefficient which is stored in a memory. At the same time, it is preferably provided that the weighted signal which is proportional to the field strength is limited to a maximum value.

Another advantageous embodiment comprises the masking being carried out by a reduction in the stereo channel isolation, the weighting being carried out by multiplication by a coefficient which is stored in a memory.

Although, in the case of the circuit arrangement according to the invention, the coefficients can also be permanently stored, a development of the invention is particularly advantageous in that the coefficient or coefficients is or are stored in a non-volatile memory and can be varied with the aid of a microcomputer, a display device and a control device and with the aid of a program for operator guidance.

As a result of this development, it is possible to match individual items in a large batch of broadcast radio receivers to different operational conditions which may, for example, be typical of a state. It can also be made possible for a service workshop or even the user to vary the coefficients.

Another development of the invention comprises weighting of the filtered signal which is proportional to the field strength being carried out both for masking by reduction of the stereo channel isolation and for masking by attenuation of the audio signals. In this way, a range of interference types which are governed by the field strength glitches can be made largely inaudible.

A further improvement in the circuit arrangement according to the invention is possible by the weighted field strength signals being combined with auxiliary signals to form masking signals, which auxiliary signals indicate the presence of interference signals. In this case, combination with the auxiliary signals is preferably carried out by multiplication.

Finally, an important advantageous feature of the invention comprises two low-pass filters being provided for low-pass filtering of the signal which is substantially proportional to the field strength, the output signal of a first low-pass filter being used to form a masking signal for reducing the stereo channel isolation, and the output signal of the first low-pass filter or of a second low-pass filter being used, as a function of the presence of interference signals, to form the masking signal which produces the attenuation of the audio signals.

As a result of this development, the stereo channel isolation is also reduced in the event of relatively short field strength glitches, while the attenuation of the signals as a function of the presence of interference signals in the received signal is carried out in the event of field strength glitches which may or may not be short.

BRIEF DESCRIPTION OF THE DRAWING

Exemplary embodiments of the invention are illustrated in a plurality of figures in the drawing and are explained in more detail in the following description.

DESCRIPTION OF THE PREFERRED EMBODIMENTS

Identical parts are provided with the same reference symbols in the figures. The circuit arrangement according to the invention can be implemented in various ways. Thus, for example, individual blocks or groups of the illustrated blocks can be implemented by suitable circuits, in particular integrated circuits. Furthermore, in the case of very large scale integration, it is possible to implement all the digital signal processing of the receiver in an integrated circuit, signal processing steps, such as filtering operations or non-linear weightings for example, being carried out by computation operations. Digital signal processors and other digital circuits, such as shift registers, flipflops etc. for example, can also be arranged together within an integrated circuit in order to implement a receiver having the circuit arrangement according to the invention.

Figure 1:
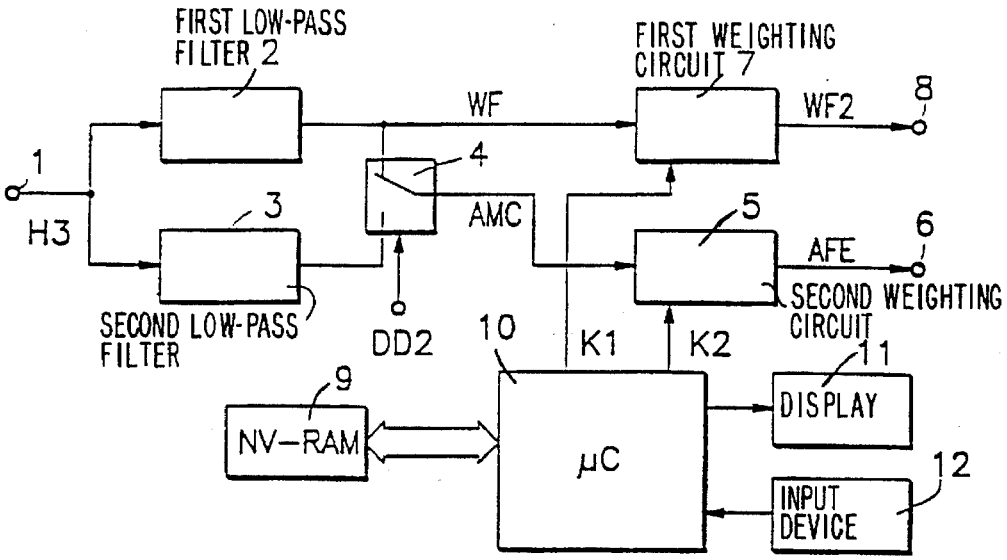
FIG. 1 is a block diagram of a first exemplary embodiment of a circuit arrangement according to the invention.

In the case of the exemplary embodiment according to FIG. 1, a signal H3 is supplied to an input 1. The signal H3 is substantially proportional to the received field strength and is designated the auxiliary signal H3 in the following text. This signal is averaged, with different time constants, in two low-pass filters 2, 3. A changeover switch 4 passes on one of the output signals from the low-pass filters 2, 3, as the signal AMC, according to the signal DD2, which will be explained later. This signal AMC is weighted in second weighting circuit 5 in order to produce the signal AFE, which indicates the noise surge attenuation and can be picked off at an output 6. The signal WF is likewise weighted in first weighting circuit 7 with a shorter time constant and can be picked off at an output 8 as the signal WF2.

Coefficients K1, K2 which are required for weighting are stored in a non-volatile memory 9 and are supplied via a microcomputer 10 to the weighting circuits 5, 7. K1 and K2 can be individual coefficients or in each case one group of coefficients. A display device 11 and an input device 12 are connected to the microcomputer 10. The microcomputer 10 is provided with a program which allows the coefficients to be set, guided by a menu.

Figure 2:
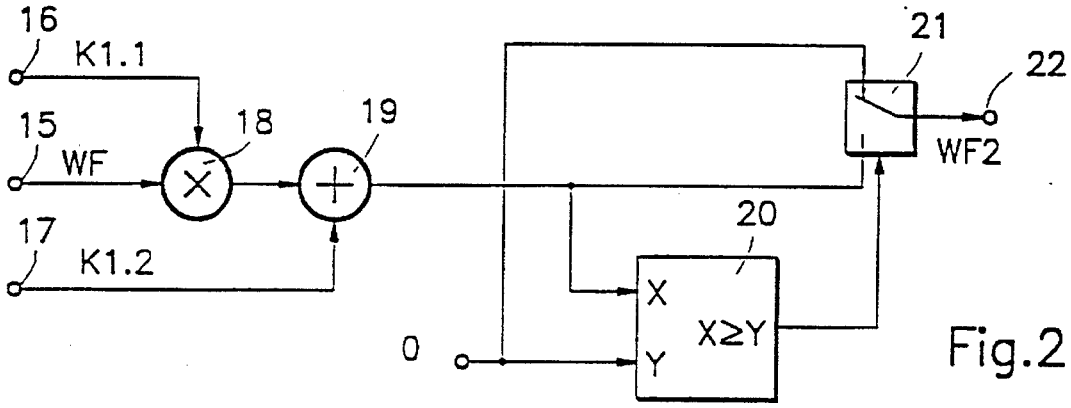
FIG. 2 is a detailed block diagram of part of the exemplary embodiment of FIG. 1.

FIG. 2 shows details of the circuit 7 (FIG. 1). The signal WF can be supplied to an input 15, while coefficients K1.1 and K1.2 are supplied to inputs 16, 17. The signal WF is multiplied by the coefficient K1.1 in a multiplier 18. The product is subsequently added to the coefficient K1.2 in adder 19.

In order that the signal WF2 at the output 22 does not assume any negative values, the output signal of the adder 19 is compared at 20 with the value 0 and, in the event of negative values, is replaced by the value 0 with the aid of a changeover switch 21.

Figure 3:
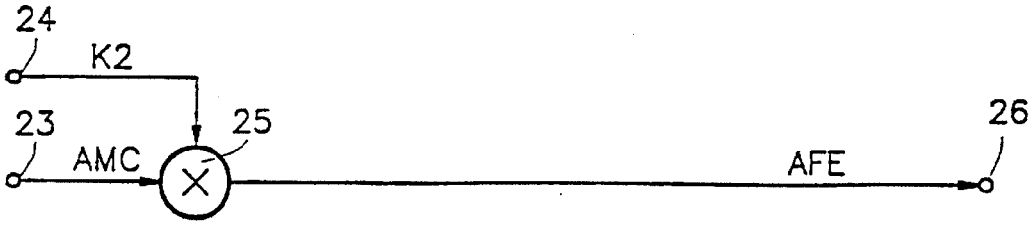
FIG. 3 is a detailed block diagram of a further part of the exemplary embodiment of FIG. 1.

FIG. 3 shows an example of a weighting circuit 5 (FIG. 1) in which the signal AMC which is supplied at 23 is multiplied at 25 by a coefficient K2 which is present at the input 24. The signal AFE can be picked off at an output 26.

Figure 4:
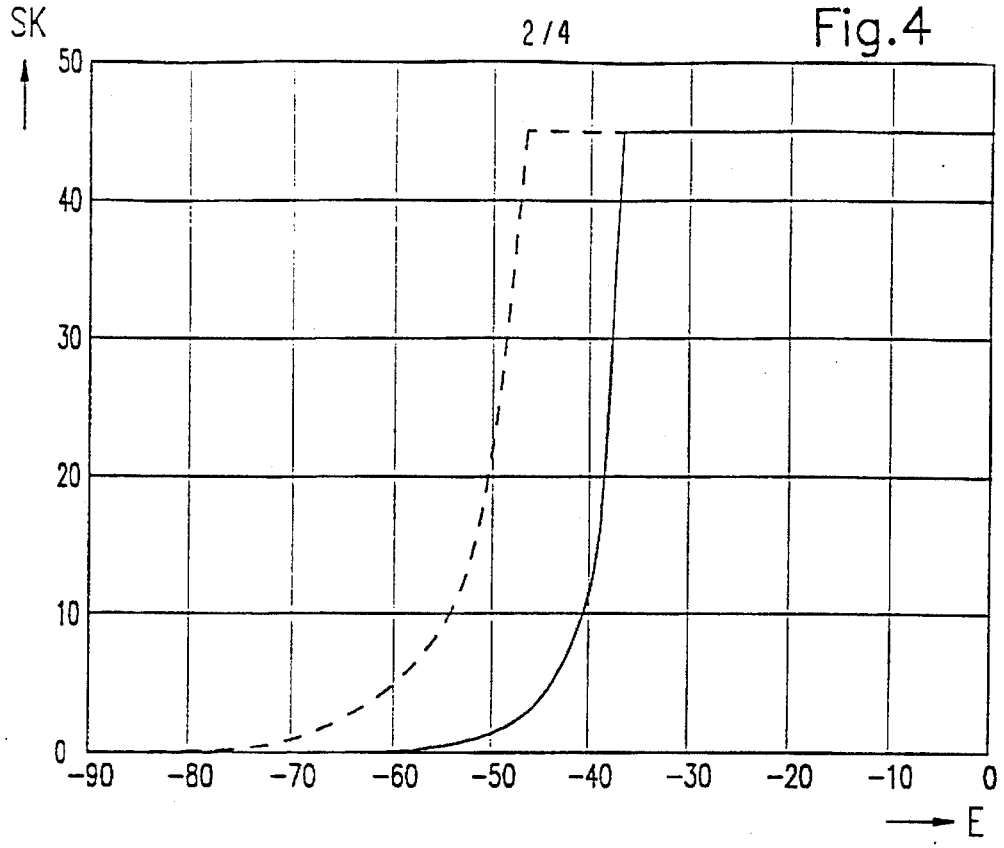
FIG. 4 is a graphical illustration of the dependency of the stereo channel isolation on the received field strength.

The dependency of the stereo channel isolation SK on the received field strength E which is illustrated in FIG. 4 can be set with the aid of the coefficients K1.1 and K1.2. A solid curve and a dashed curve are illustrated as examples. The coefficient K1.1 essentially allows the gradient to be set, and the coefficient K1.2 allows the field strength axis shift to be set. The illustrated curve includes the dependency of the stereo channel isolation on the signal WF2, which dependency is given by characteristics within the stereo decoder.

Figure 5:
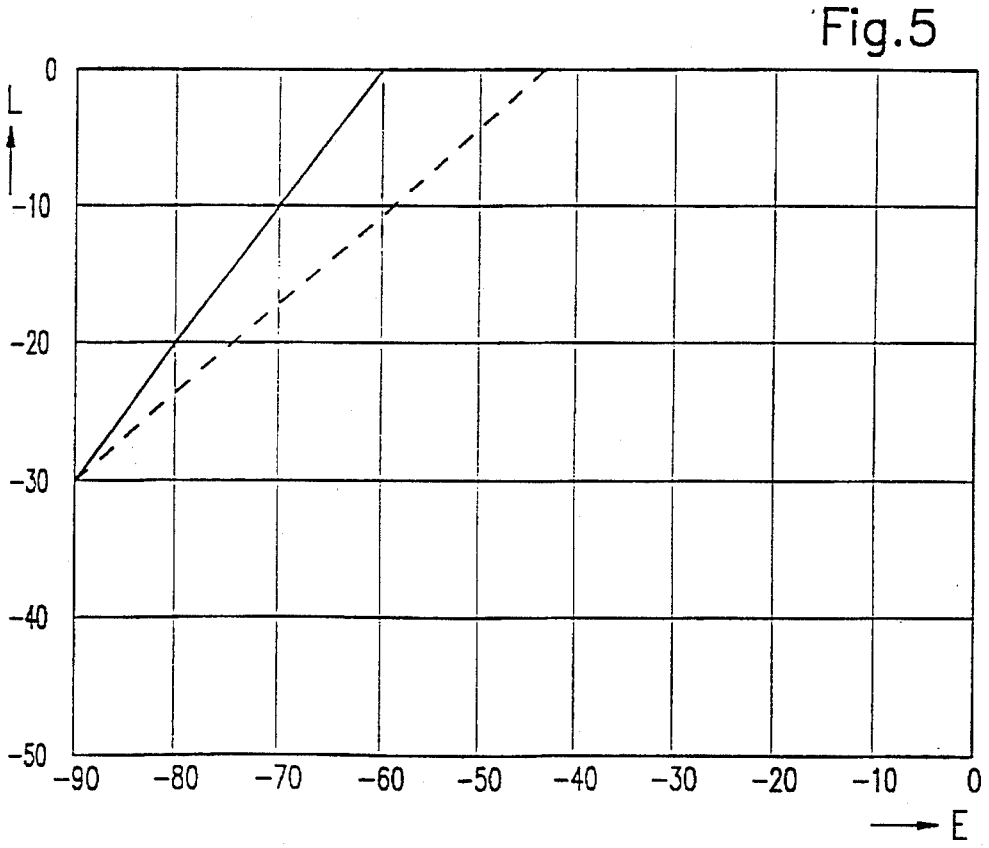
FIG. 5 is a graphical illustration of the dependency of the attenuation of the audio signals on the received field strength.

FIG. 5 shows the attenuation L as a function of the received field strength E for two different values of the coefficient K2. Varying the coefficient allows the gradient and the start (0-dB point) of the attenuation and of the volume reduction respectively to be set simultaneously in the event of the received field strength becoming smaller.

Figure 6:
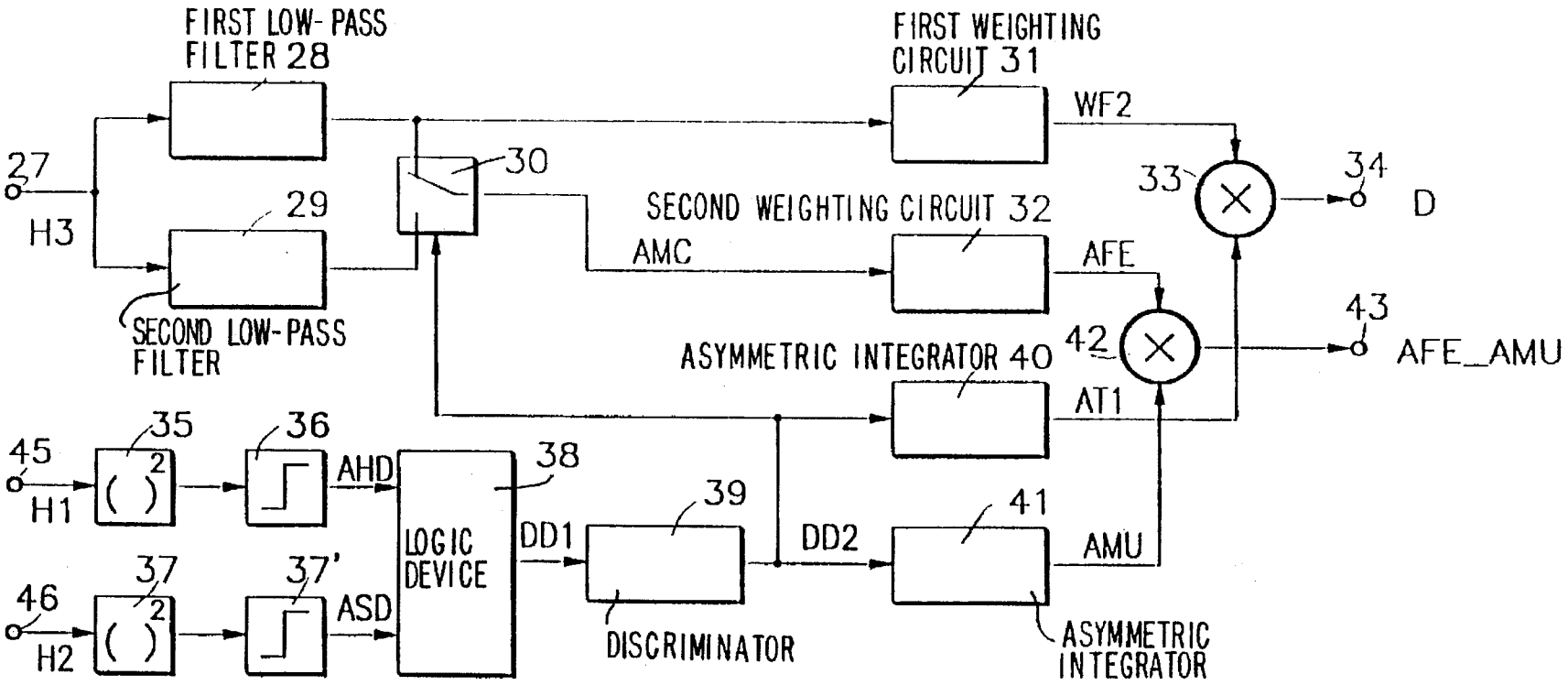
FIG. 6 is a block diagram of a second exemplary embodiment of a circuit arrangement according to the invention.

FIG. 6 shows a second exemplary embodiment. The auxiliary signals H1, H2 and H3 are supplied to inputs 45, 46, 27. The auxiliary signal H3 which designates the received field strength is averaged, with different time constants, in two low-pass filters 28, 29. A changeover switch 30 passes on one of the output signals from the low-pass filters 28, 29, as the signal AMC, as a function of the signal DD2 which will be explained later. This signal AMC is weighted in a second weighting circuit 32 in the form of a noise surge curve in order to produce the noise surge attenuation AFE. The field strength signal having the smaller time constant is furthermore likewise weighted in a first weighting circuit 31 (signal WF2). This signal is multiplied at 33 by a signal AT1 In order to form the control signal D which is available at the output 34.

Figure 7:
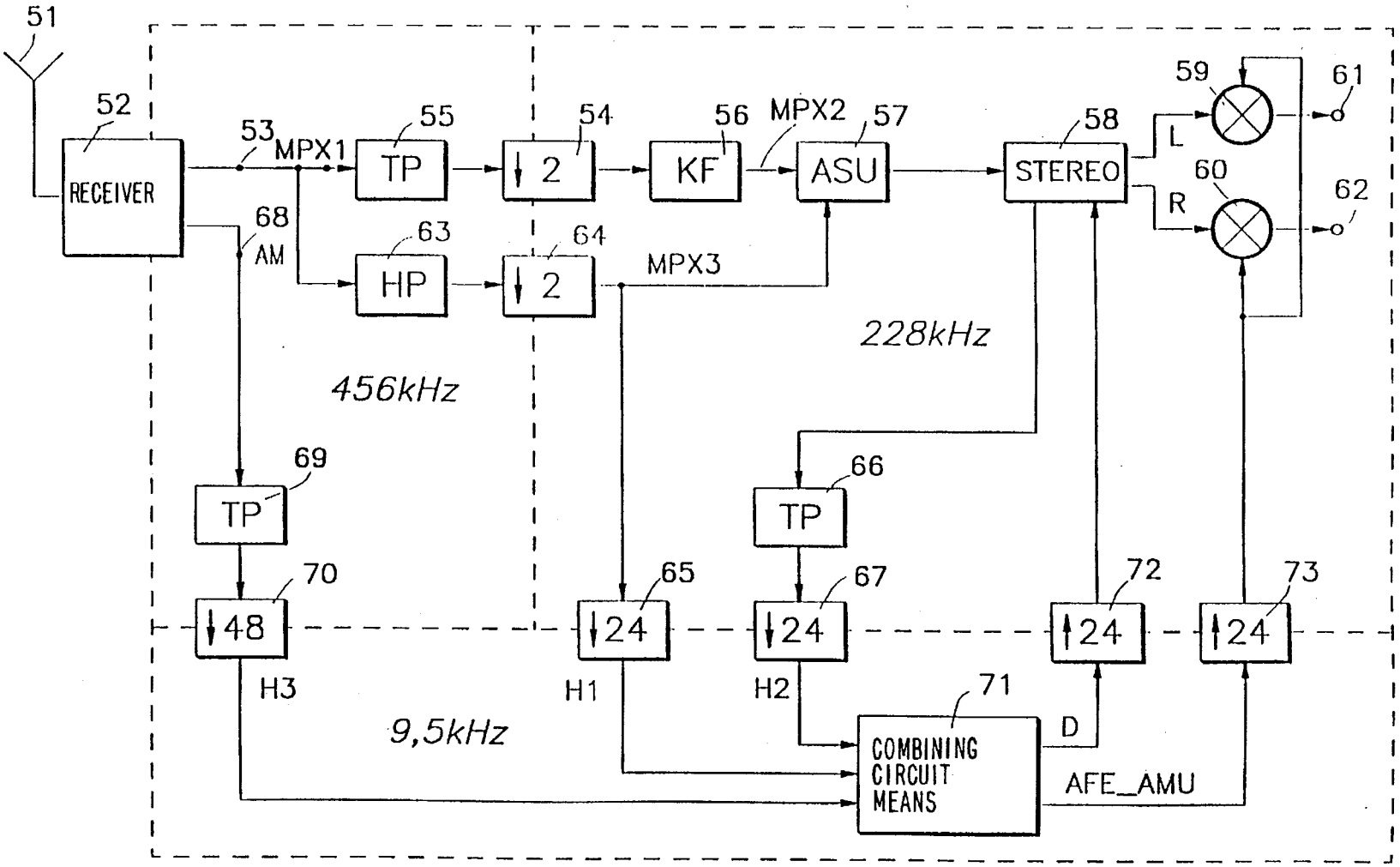
FIG. 7 is a block diagram showing essential parts of the broadcast radio receiver having a circuit arrangement according to the invention.

Auxiliary signals H2 and H1, whose production is explained in more detail in conjunction with FIG. 7, are used to produce the signal DD2. The auxiliary H1, which represents the spectral components above the useful range of the stereo multiplex signal, is for this purpose initially squared at 35, as a result of which a measure of the energy content of these components is formed. This is passed, at 36, via a threshold value detector so that a signal AHD is produced which indicates the presence of spectral components having an energy which is greater than a predetermined threshold. The auxiliary signal H2, which is formed from the symmetry signal SY (FIG. 1), is passed after being squared at 37 via a threshold value detector 37' whose output signal ASD thus indicates asymmetries which exceed a predetermined threshold. Such asymmetries indicate, inter alia, the presence of adjacent-channel interference.

In many applications, the use of one of the signals AHD or ASD as the signal DD2 on its own results in considerable advantages. However, two detectors 36, 37 are provided in the case of the illustrated exemplary embodiments, their output signals AHD and ASD being passed via a controllable logic network 38. On the one hand, this has the advantage that, in the case of pure monotransmissions in which no carrier-frequency stereo signal is transmitted, the signal DD2 is derived from the auxiliary signal H1. It is likewise also possible to derive the signal DD2 in the case of methods for stereo signal transmission which differ from the European standard—for example using the FMX method in the USA.

The logic network 38 makes it possible to select or logically link the two signals AHD and ASD to form the signal DD1. The logic network 38 can be formed in a simple manner from a controllable four-way switch whose inputs can be supplied with the signals AHD and ASD, an or-linking of these signals and an and-linking of these signals. The signal DD1, which is supplied to a pulse-width discriminator 39, is then available at an output of the controllable changeover switch. This ensures that the signal DD2 does not indicate interference until the signal DD1 has been active for an adjustable minimum time.

In addition to controlling the changeover switch 30, the signal DD2 is used as a trigger signal for two asymmetric integrators 40, 41. These include essentially in each case one counter which jumps to 0 or another predetermined value at the moment of triggering and retains this value as long as the signal DD2 is at 0. If the signal DD2 then assumes the logic level 1, the output signals AT1 and AMU of the asymmetric integrators 40, 41 rise linearly to a maximum value, with adjustable time constants. The signal AT1 is supplied to a multiplier 33, together with the field strength signal WF2 which has been weighted weighting circuit 31.

The output signal AMU of the asymmetric integrator 41 is multiplied at 42 by the signal AFE, as a result of which a signal AFE_AMU is produced which produces a maximum attenuation of the audio signals of 33 dB with the aid of the multipliers 9, 10 (FIG. 1). This signal can be picked off from the circuit at the output 43.

The exemplary embodiments which have been explained with reference to FIGS. 1 to 6 are parts of a broadcast radio receiver having digital signal processing, for which receiver an exemplary embodiment is illustrated in FIG. 7. The signal, which is received via an antenna 51, is amplified, selected and demodulated in a receiving section (tuner) 52 in a manner known per se. A stereo multiplex signal MPX1 is available, at a sampling rate of 456 kHz, at an output 53 of the receiving section 52. In order to achieve a subsequent reduction in the sampling rate—also called decimation—to 228 kHz without aliasing interference, a low-pass filter 55 is provided upstream of the sampling-rate reduction 54. A low-pass filter having a flat frequency response in the passband is required, per se, for correct further processing of the stereo multiplex signal. In order to save the complexity required for this, particularly at the high sampling rate of 456 kHz, a simpler low-pass filter having a falling frequency response is provided in the case of the exemplary embodiment. The drop in the frequency response is, however, compensated for in a subsequent compensation filter 56.

The stereo multiplex signal MPX2 is passed after this via a circuit 57 for automatic noise suppression which, in particular in the event of radio interference occurring, repeats samples before the start of the interference until the end of the interference. This circuit is followed by a stereo decoder 58 which produces two audio signals L, R which are passed via multipliers 59, 60 to outputs 61, 62. The audio signals are supplied from there via AF amplifiers to the loudspeakers.

A signal is produced from the stereo multiplex signal MPX1 with the aid of a high-pass filter 63 and a decimation circuit 64, which signal includes signal elements which exist above the useful frequency band of the stereo multiplex signal but which are convolved by decimation into a lower frequency band. This signal MPX3 exhibits various types of interference, for example the interference produced by ignition sparks of vehicles. It is used on the one hand to control the circuit 57 for automatic noise suppression and on the other hand to form the auxiliary signal H1 by decimation of the sampling rate to 9.5 kHz at 65.

The auxiliary signal H2, whose sampling rate is likewise 9.5 kHz, is formed by low-pass filtering at 66 and decimation at 67 from a symmetry signal SY. This signal is in turn formed in the stereo decoder 58. There, the stereo auxiliary carrier is amplitude-demodulated in a known manner to form the difference signal L-R. This is done by the auxiliary carrier being multiplied by an auxiliary carrier which is regenerated in the broadcast radio receiver, in the same phase. In the stereo decoder 58, the stereo auxiliary carrier is additionally multiplied by a carrier which has been shifted through 90° with respect to the reference carrier, as a result of which a signal is produced which is 0 if the side bands of the stereo auxiliary carrier are symmetrical and correspondingly differs from 0 in the event of asymmetries. The further auxiliary signal H2 is formed from this signal by low-pass filtering at 66 and decimation at 67.

The receiving section 52 emits at an output 68 a signal AM which is produced by amplitude demodulation of the FM intermediate-frequency signal. This signal AM likewise has a sampling rate of 456 kHz in the case of the illustrated exemplary embodiments and, after low-pass filtering 69 at 70, is decimated by the factor 48 so that the third auxiliary signal H3 which is produced has a sampling rate of 9.5 kHz.

In the circuit 71 (for details, see FIG. 6), the auxiliary signals H1, H2 and H3 are combined with one another to form control signals D and AFE_AMU whose sampling rate is initially 9.5 kHz but is raised to 228 kHz at 72 and 73. This is done by interpolation of in each case 24 samples, which interpolation in the simplest case comprises each sample being repeated 24 times. The control signal D is supplied to a control input of the stereo decoder 58 and is used there to change over to mono mode in the event of reception being subject to interference. The signal AFE_AMU is supplied to the multipliers 59 and 60, as a result of which the volume is reduced (masking) when interference is present.

We claim:

1. A circuit arrangement for deriving masking signals for masking audio signals in a broadcast radio receiver, said circuit arrangement comprising first low-pass filter means (2) for filtering an input signal (H3) substantially proportional to a received field strength in the radio receiver to form a first low-pass filter output signal;

second low-pass filter means (3) for filtering said input signal (H3) to form a second low-pass filter output signal;

first weighting circuit means (7) for weighting the first low-pass filter output signal of the first low-pass filter means (2) with a plurality of first coefficients to form a first weighted output signal;

means for forming a masking signal for reducing stereo channel isolation from the first weighted output signal of the first weighting circuit means (7);

second weighting circuit means (5) for forming a second weighted output signal by weighting with a plurality of second coefficients either the first low-pass filter output signal or the second low-pass filter output signal according to a switching signal (DD2) indicative of the presence of interference in the audio signals;

means (4) for selecting the first low-pass filter output signal for weighting in the second weighting circuit means (5) when no interference is indicated by the switching signal (DD2) and the second low-pass filter output signal for weighting in the second weighting circuit means (5) when interference is indicated by the switching signal (DD2); and means for forming a masking signal for damping the audio signal from the second weighted output signal of the second weighting circuit means (7).

2. The circuit arrangement as claimed in claim 1, further comprising a nonvolatile memory (9) in which predetermined values of the first and second coefficients are stored, a microcomputer (10) connected with said nonvolatile memory (9), a display device (11) connected to the microcomputer (10) and a control device (12) connected to the microcomputer (10), said microcomputer (10) including program means for changing said values of said first and second coefficients.

3. The circuit arrangement as claimed in claims 1, further comprising means for deriving auxiliary signals (H1,H2) from said interference in said audio signals and means for combining said auxiliary signals (H1,H2) with said first and second weighted output signals to form the masking signals.

4. The circuit arrangement as claimed in claim 3, wherein said means for combining the first and second weighted output signals with the auxiliary signals (H1,H2) comprises means (33,42) for multiplying.

5. The circuit arrangement as claimed in claim 1, further comprising means (35,36) for detecting when energies of spectra components of the audio signals above a predetermined useful range of a stereo multiplex signal of the radio receiver exceed a predetermined energy threshold over a predetermined time period to indicate when said interference is present in the audio signals.

6. The circuit arrangement as claimed in claim 1, further comprising means for limiting the first weighted output signal proportional to the received field strength to a maximum value.

7. The circuit arrangement as claimed in claim 1, further comprising means for limiting the masking signal for reducing the stereo channel isolation to non-negative values.

* * * * *